US005088847A

United States Patent [19]

Oda

[11] Patent Number: 5,088,847

[45] Date of Patent: Feb. 18, 1992

[54] SETTING VARIABLE CHARACTER WIDTH IN MATRIX PRINTER

[75] Inventor: Akira Oda, Shizuoka, Japan

[73] Assignee: Tokyo Electric Co., Ltd., Tokyo, Japan

[21] Appl. No.: 571,828

[22] Filed: Aug. 24, 1990

Related U.S. Application Data

[63] Continuation of Ser. No. 310,590, Feb. 15, 1989, abandoned.

[30] Foreign Application Priority Data

Feb. 18, 1988 [JP] Japan ..... 63-35516

[51] Int. Cl.[5] ..... B41J 19/32

[52] U.S. Cl. ..... 400/306; 400/121

[58] Field of Search ..... 400/3, 1, 6, 16–17, 400/121, 303, 306, 582

[56] References Cited

U.S. PATENT DOCUMENTS

| | | | |
|---|---|---|---|
| 4,459,431 | 7/1984 | Hiroichi et al. | 400/121 |
| 4,556,332 | 12/1985 | Maekawa | 400/54 |
| 4,591,969 | 5/1986 | Bloom | 400/582 |
| 4,653,940 | 3/1987 | Katsukawa | 400/121 |
| 4,655,622 | 4/1987 | Aoki | 400/121 |
| 4,737,924 | 4/1988 | Miki | 400/121 |
| 4,776,713 | 10/1988 | Takahashi et al. | 400/144.2 |
| 4,844,635 | 7/1989 | Malkemes | 400/124 |

FOREIGN PATENT DOCUMENTS

| | | | |
|---|---|---|---|
| 0105095 | 4/1984 | European Pat. Off. | 400/322 |
| 129544 | 11/1978 | Japan | 400/9 |
| 56-145475 | 11/1981 | Japan | 400/322 |
| 105093 | 6/1982 | Japan | 400/9 |
| 60-183163 | 9/1985 | Japan | 400/303 |
| 60-196386 | 10/1985 | Japan | 400/303 |
| 60-206362 | 10/1985 | Japan | 400/303 |
| 264258 | 12/1985 | Japan | 400/303 |
| 197250 | 9/1986 | Japan | 400/303 |
| 62-6322 | 1/1987 | Japan | 400/303 |
| 62-146662 | 6/1987 | Japan | 400/303 |
| 196280 | 11/1987 | Japan | 400/9 |

OTHER PUBLICATIONS

I.B.M. Technical Disclosure Bulletin, vol. 28, No. 10, Mar. 1986, 4332–4336.

*Primary Examiner*—David A. Wiecking
*Assistant Examiner*—Steven S. Kelley
*Attorney, Agent, or Firm*—Oblon, Spivak, McClelland, Maier & Neustadt

[57] ABSTRACT

When a specified head energizing pulse interval involves a decimal fraction, the fraction is accumulated at every printing, and when the cumulative value of the fraction is smaller than one pulse, a printing head is driven at a pulse interval of an integer part obtained by subtracting the fraction, and when the cumulative value of the fraction has reached one pulse, the printing head is driven at a pulse interval of an integer obtained by adding one pulse to the above head energizing pulse interval.

2 Claims, 4 Drawing Sheets

SETTING VARIABLE CHARACTER WIDTH IN MATRIX PRINTER

This application is a continuation of application Ser. No. 07/310,590, filed on 02/15/89, now abandoned.

FIELD OF THE INVENTION AND RELATED ART STATEMENT

The present invention relates to a method for setting a character width in a printer for forming characters and symbols using a dot matrix.

PRIOR ART

In printers there are adopted such printing forms as pica and elite. These printing forms are different in the number of characters per inch. In the case of pica the number of characters is 10, while it is 12 in the case of elite, whereby the width of one character is determined. And a printing head is driven at a head energizing pulse interval decided according to the character width.

However, other than the printing form of pica or elite, the printing width of one line and the number of characters to be printed in one line are sometimes specified. In this case, the value of the head energizing pulse interval sometimes involves a decimal fraction. Actually, therefore, it is required to give considerations in this connection, for example, required to form spaces at both ends of a line, and thus the printing form setting operation is troublesome.

OBJECT AND SUMMARY OF THE INVENTION

It is the first object of the present invention to have printing performed in the same manner as at a heat energizing pulse interval of an integer in appearance even in the case of a head energizing pulse interval involving a decimal point.

It is the second object of the present invention to make adjustment of a head energizing pulse interval with a decimal point dispersedly in one line in the case where the printing width of one line and the number of characters to be printed in one line are specified in printing.

It is the third object of the present invention to simplify the operation in the case where the printing width of one line and the number of characters to be printed in one line are specified in printing.

It is the fourth object of the present invention to attain the aforesaid functions using a simple apparatus.

According to the present invention, in a dot printer for printing characters, etc. using a dot matrix by driving a printing head at a predetermined head energizing pulse interval during movement of a carrier which carries the printing head, when the specified head energizing pulse interval involves a decimal fraction, the fraction is accumulated at every printing, and when the cumulative value of the fraction is smaller than one pulse, the printing head is driven at a pulse interval of an integer part obtained by subtracting the fraction, and when the cumulative value of the fraction has reached one pulse, one pulse is added to the above head energizing pulse interval, and the printing head is driven at a pulse interval of an integer part obtained by subtracting the decimal fraction from the one pulse-added head energizing pulse interval. These operations are repeated.

Therefore, the printing head is driven at a predetermined head energizing pulse interval during movement of the carrier which carries the printing head, whereby printing is effected. But where the head energizing pulse interval involves a decimal fraction, the printing head is driven at a pulse interval of an integer part obtained by subtracting that fraction or at an integer pulse interval obtained by accumulating the fraction and adding one pulse.

DETAILED DESCRIPTION OF PREFERRED EMBODIMENTS

Figure 1:
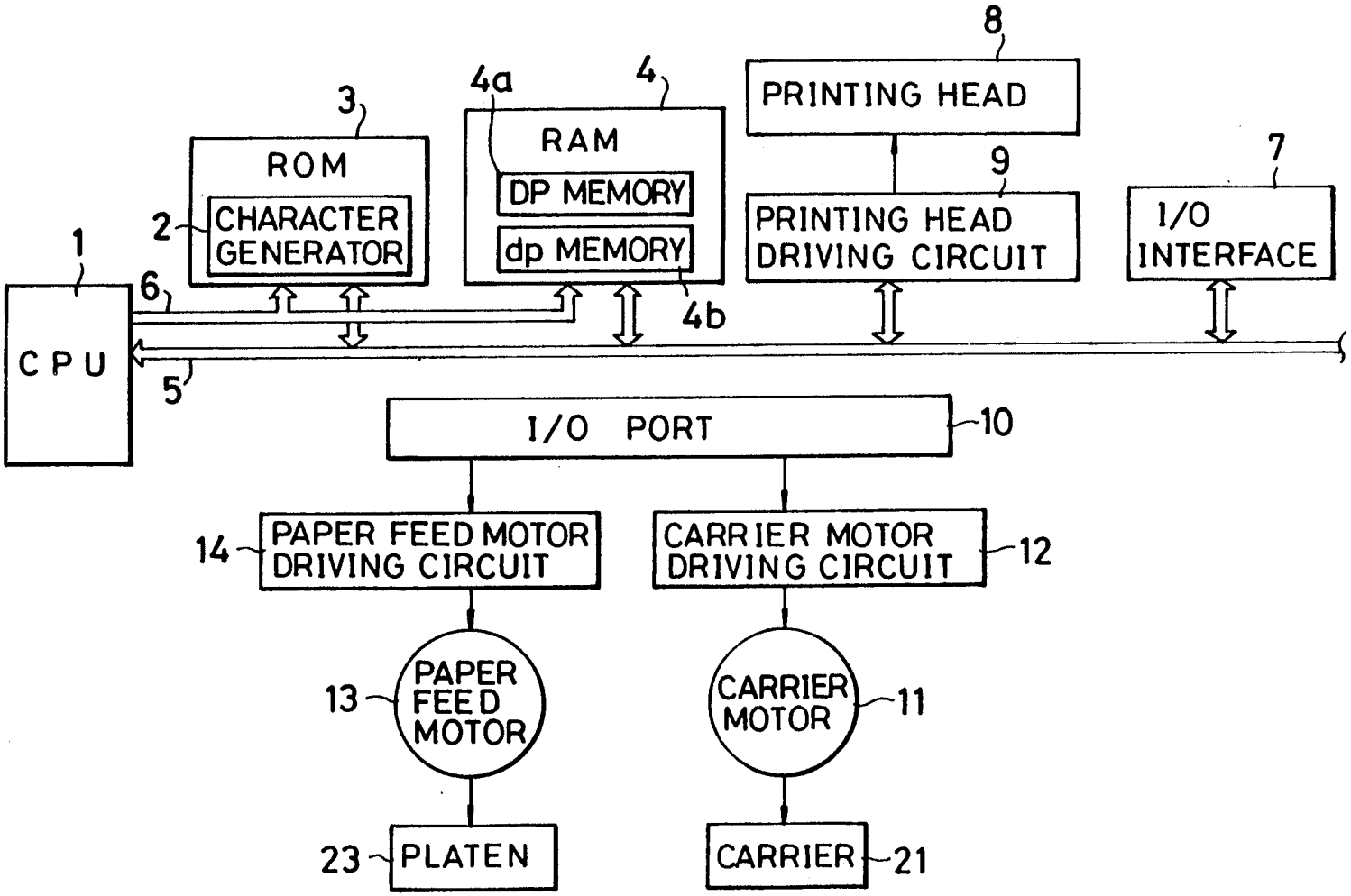
FIG. 1 is a block diagram showing an electronic circuitry.

An embodiment of the present invention will now be described with reference to the accompanying drawings. Referring first to FIG. 1, there is illustrated an electronic circuitry, in which the numeral 1 denotes a CPU. To the CPU 1 are connected a ROM 3 in which are stored fixed data such as a character generator 2 and programs, and a RAM 4 in which are stored various data for modification, through a data bus 6 and an address bus 5. Further, an I/O interface 7 for the connection of an external controller to output various command signals such as character codes and a printing head driving circuit 9 for driving a printing head 8 are also connected to the CPU 1 through the address bus 5. Further connected to the CPU 1 is an I/0 port 10 through the address bus 5. To the I/O port 10 are connected a carrier motor driving circuit 12 for driving a carrier motor 11 and a paper feed motor driving circuit 14 for driving a paper feed motor 13. The paper feed motor 13 drives a platen 23 which serves as a paper feed roller, and along the platen 23 is disposed a carrier 21 which is driven by the carrier motor 11. The carrier motor 11 moves the carrier 21 which carries the printing head 8, along the platen 23 with 720 pulses per inch.

Figure 2:
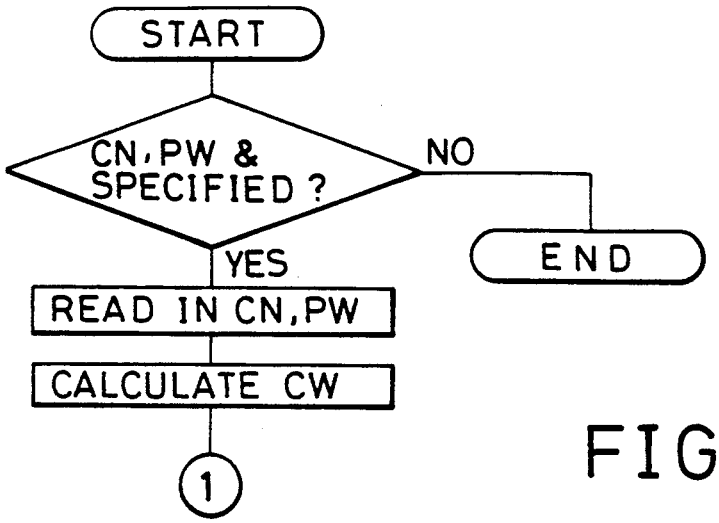
FIG. 2 is a flowchart showing how to set a character width in an ordinary form.

How to actually set a character width will now be explained. As shown in the flowchart of FIG. 2, when the number of characters, CN, to be printed in one line and the printing width, PW, of one line are given through the I/O interface 7, the data of the CN and PW are read into the RAM 4 and the number of lateral pulses, CW, per character is calculated by the CPU 1 on the basis of the data CN, PW, 720 pulses with which the carrier is advanced one inch, and the number of lateral dots, 12, of one character.

First, the number of characters per inch, C/I, is calculated by dividing the number of characters, CN, to be printed in one line by the printing width PW (inch) of one line. The results of this calculation are as shown in Table 1 below.

TABLE 1

| | CN | PW | C/I |
|---|---|---|---|
| Pica | 80 | 8 | 10 |

TABLE 1-continued

| | CN | PW | C/I |
|---|---|---|---|
| Elite | 96 | 8 | 12 |
| Another Example | 80 | 7 | 11.4 |

Next, since the carrier is driven 720 pulses per inch as noted previously, the number of lateral pulses, CW, per character is calculated by dividing the driving pulses 720 by the number of characters per inch.

If the number of dots in the width direction per character is assumed to be 12 and the number of pulses in the width direction, CW, per character is divided by the said number of dots, there is calculated a head energizing pulse interval DP. The results of this calculation are as shown in Table 2.

TABLE 2

| | CW | DP |
|---|---|---|
| Pica | 72 | 6 |
| Elite | 60 | 5 |
| Another Example | 63 | 5.25 |

Figure 4:
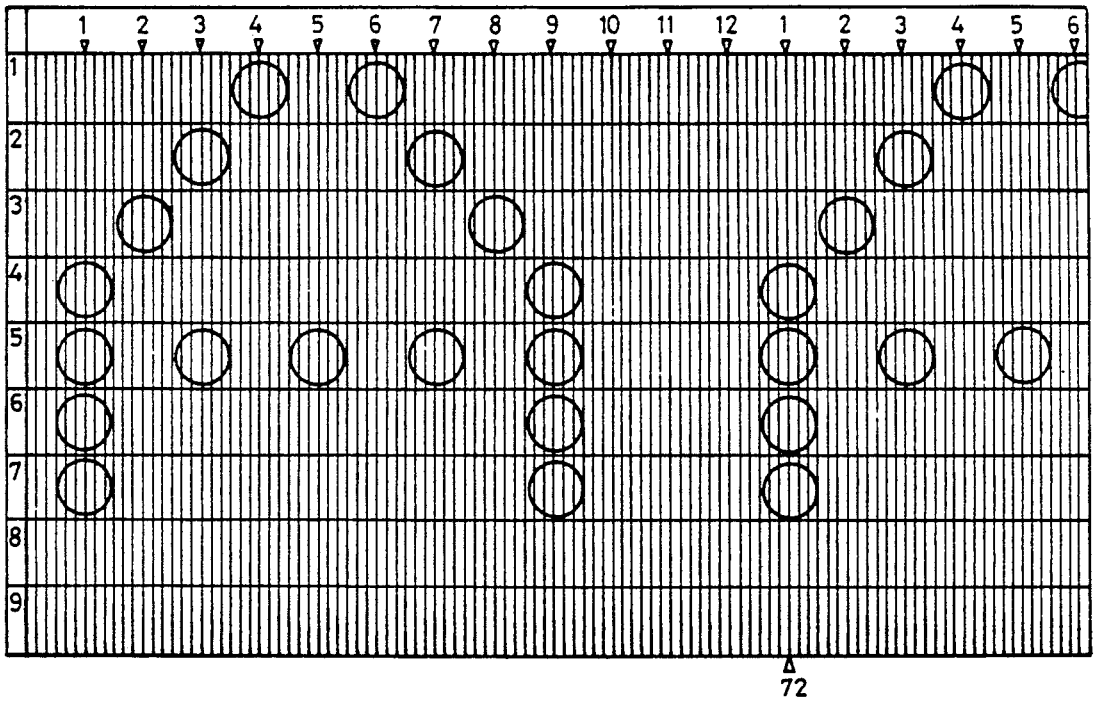
FIG. 4 is an explanatory view showing a printed state in the form of pica.

In the case of pica, as shown in FIG. 4, one character interval, including space, corresponds to 72 pulses, and during this movement the printing head 8 is driven at a head energizing pulse interval of 6 pulses to effect printing with 12 dots in the width direction. The printed character is "A".

Figure 5:
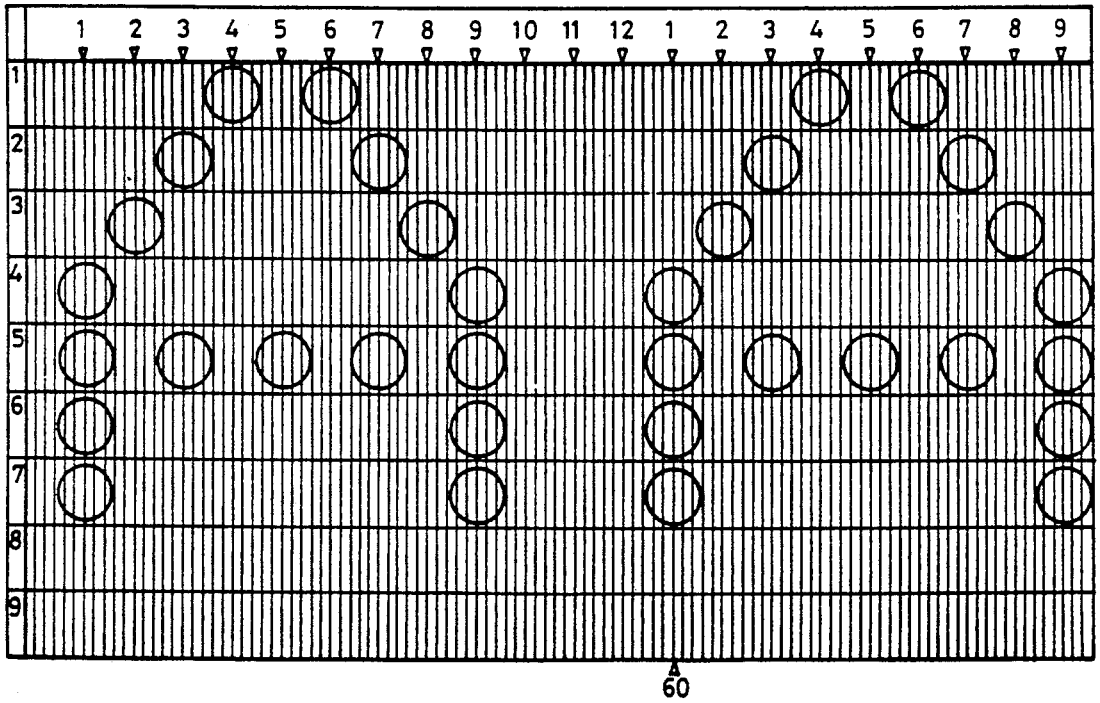
FIG. 5 is an explanatory view showing a printed state in the form of elite.

Likewise, in the case of elite, as shown in FIG. 5, one character interval, including space, corresponds to 60 pulses, and during this movement the printing head 8 is driven at a head energizing pulse interval of 5 pulses to effect printing with 12 dots in the width direction.

As another example, where 80 characters are to be printed in the printing width of 7 inches, the head energizing pulse interval DP becomes 5.25 and thus there are fractions in decimal places, so it has heretofore been impossible to set a character width. But the present invention solves this problem.

Figure 3:
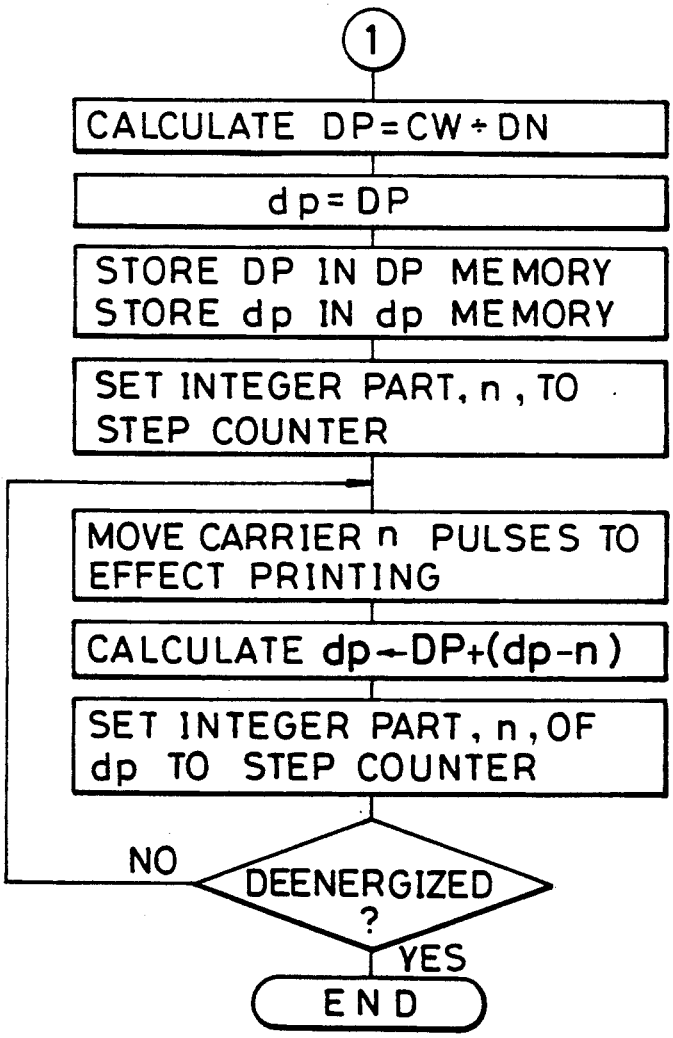
FIG. 3 is a flowchart showing how to set a character width in the case of a head energizing pulse interval involving a fraction.

More specifically, an explanation will now be made with reference to the flowchart of FIG. 3. First, the head energizing pulse interval DP is calculated by dividing the number of lateral pulses, CW, per character by the number of lateral dots, DN, per character, as previously noted. Therefore, where the head energizing pulse interval DP is 5.25 as shown in Table 2, as an example other than pica and elite, the 5.25 is read in as DP=dp. Then, the 5.25 is stored as a constant value DP in a DP memory 4*a* which serves as a head energizing pulse interval storage means of the RAM 4, while (5.25−5) is stored as a variable value dp in a dp memory 4*b* which serves as a decimal storage means of the RAM 4. Then, an integer part, n, (corresponding to 5 pulses) of the dp is set to a step counter which serves as an integer storage means of the RAM 4. Subsequently, the carrier motor 11 is driven n pulses (5 pulses) to move the carrier n pulses (5 pulses) together with the printing head 8, whereupon the head 8 is driven by the printing head driving circuit 9 to effect dot printing. Then, there is performed the calculation of dp←DP+(dp−n). In this case, the calculation is 5.25+(5.25−5). The fractions of 0.25 are accumulated by an accumulating means to update the data dp. Where this updated value involves a decimal fraction, the integer part, n, pulses (5 pulses) are set to the step counter and the carrier motor 11 is driven n pulses (5 pulses) to move the carrier n pulses (5 pulses) together with the printing head 8, whereupon the printing head 8 is driven to repeat dot printing.

In the step of calculating dp←DP+(dp−n), as set forth above, the fractions in decimal places are added every time one dot is printed to update data, that is, the fractions 0.25 are accumulated. As a result, as shown in Table 3, dp is updated like 5.25, 5.5, 5.75 and 6 pulses successively at every printing.

TABLE 3

| Updated Value | | Constant Value | | Variable Value |
|---|---|---|---|---|
| 5.25 | ← | DP | + | (dp − n) |
| 5.50 | ← | 5.25 | + | (5.25 − 5) |
| 5.75 | ← | 5.25 | + | (5.50 − 5) |
| 6.00 | ← | 5.25 | + | (5.75 − 5) |
| 5.25 | ← | 5.25 | + | (6.00 − 6) |

Figure 6:
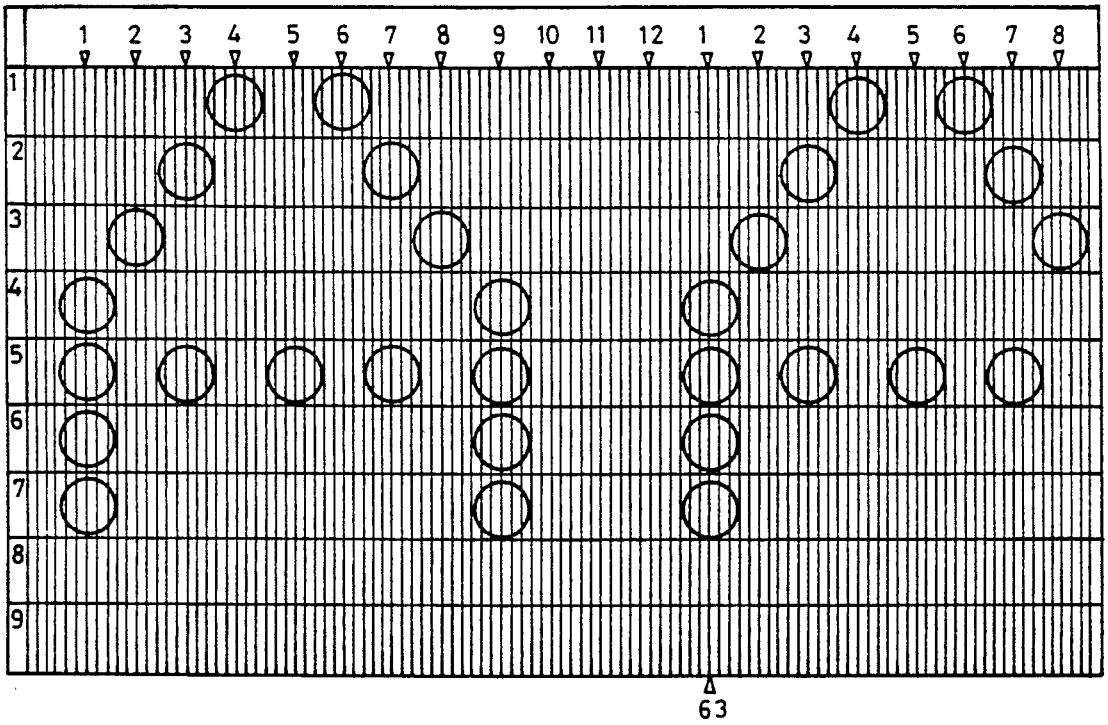
FIG. 6 is an explanatory view showing a printed state obtained at a head energizing pulse interval involving a fraction.

The fractions are subtracted except 6 pulses and the printing head 8 is driven at intervals of 5 pulses, while the fractions are accumulated until exceeding one pulse, whereupon the printing head 8 is energized at intervals of 6 pulses. Thus, as shown in FIG. 6, where 80 characters of A are to be printed within the width of 7 inches, printing is performed while the head energizing pulse interval dp varies like 5, 5, 5, 6, 5, 5, 5, 6 . . . . A look at FIG. 6 shows that there are 5- and 6-pulse portions as dot intervals. But since this is only one pulse expansion of interval at every plural dots, the character image is not unnatural even in comparison with the pica of FIG. 4 and elite of FIG. 5.

Thus, even when the head energizing pulse interval involves fractions in decimal places, the fractions are accumulated and printing can be made at a head energizing pulse interval with one pulse added after printing of plural dots.

As to the type of the printing head 8, either of a wire dot head and a thermal head may be used.

According to the present invention constructed as above, the printing head is driven at a predetermined head energizing pulse interval during movement of the carrier which carries the printing head, whereby printing is effected. Where the head energizing pulse interval involves a decimal fraction, the printing head can be driven at a pulse interval of an integer part after subtraction of the fraction or at an integer pulse interval with one pulse added after accumulation of the fraction, whereby the printing form can be given diversity and the form setting operation can be simplified to a great extent.

What is claimed is:

1. A character width setting apparatus in a printer, comprising:

a CPU;

a ROM for the storage of fixed data;

a RAM for the storage of modifiable data, said RAM is provided with a step counter, said RAM having a region for a head energizing pulse interval memory storage including a decimal fraction storage and a region for storing a variable value and an accumulated variable value;

a printing head;

a printing head driving circuit connected to said printing head;

an input/output port;

a carrier motor driving circuit connected to said input/output port;

a carrier motor connected to said carrier motor driving circuit;

a carrier, driven by said carrier motor, for carrying the printing head;

a paper feed motor driving circuit connected to said input/output port;

a paper feed motor connected to said paper feed motor driving circuit;

a platen connected to said paper feed motor;

a data bus connected to said CPU, said ROM, and said RAM;

an address but connected to said CPU, said RAM, said printing head driving circuit, and said input-/output port; and means for energizing the printing head at an interval of n pulses, for a predetermined sequence of intervals of n pulses and wherein an accumulation of decimal fractions remaining is stored and such that when said accumulation of decimal fractions remaining exceeds one said printing head is energized for n+1 pulses further whereupon said predetermined sequence is repeated with the accumulation being set to any portion of a decimal fraction over one remaining in said decimal fraction memory after one has been subtracted therefrom.

2. An apparatus according to claim 1, wherein:

the printed head is driven by the carrier motor by means of the carrier along the platen at a pulse rate means of the carrier along the platen at a pulse rate of 720 pulses per inch.

* * * * *